United States Patent [19]

Shero

[11] Patent Number: 5,048,202

[45] Date of Patent: Sep. 17, 1991

[54] CARPET DRYER

[76] Inventor: William K. Shero, 30961 Steeplechase, San Juan Capistrano, Calif. 92675

[21] Appl. No.: 505,928

[22] Filed: Apr. 6, 1990

[51] Int. Cl.[5] ..... F26B 13/00

[52] U.S. Cl. ..... 34/151; 34/243 R; 34/90; 415/182.1

[58] Field of Search ..... 34/150, 151, 97, 90, 34/91, 243 R, 23; 415/182.1, 914

[56] References Cited

U.S. PATENT DOCUMENTS

| | | | |
|---|---|---|---|
| 2,156,890 | 5/1939 | Würinger | 34/243 R |
| 3,286,368 | 11/1966 | Thomas | 34/151 |
| 3,324,846 | 6/1967 | Smith | 34/243 R |
| 3,774,261 | 11/1973 | Colt | 15/321 |
| 4,109,340 | 8/1978 | Bates | 15/321 |
| 4,145,821 | 3/1979 | Schantz | 34/237 |
| 4,151,658 | 5/1979 | Hibino et al. | 34/243 R |
| 4,153,968 | 5/1979 | Perkins | 15/321 |
| 4,207,649 | 6/1980 | Bates | 15/321 X |
| 4,284,127 | 8/1981 | Collier et al. | 15/321 X |
| 4,336,627 | 6/1982 | Bascus | 15/340 X |
| 4,443,909 | 4/1984 | Cameron | 15/321 X |

FOREIGN PATENT DOCUMENTS

| | | | |
|---|---|---|---|
| 453852 | 12/1949 | Italy | 34/202 |

OTHER PUBLICATIONS

Extractomactic Carpet Care Equipment by CLEAN-CARE brochure.

*Primary Examiner*—Henry A. Bennet
*Assistant Examiner*—Denise L. F. Gromada
*Attorney, Agent, or Firm*—Stetina and Brunda

[57] ABSTRACT

An improved carpet dryer is disclosed for drying carpets saturated with water. The dryer includes a securing mechanism for maintaining the edge of a carpet on the upper surface of the air outlet portion of the device. The device further incorporates a shroud disposed on one air intake of the dryer to minimize the effects of air turbulence within the dryer unit.

17 Claims, 3 Drawing Sheets

CARPET DRYER

FIELD OF THE INVENTION

The present invention relates generally to air dryers, and more particularly to a carpet dryer which includes a mechanism for fixedly securing a carpet on the upper surface of the air outlet portion of the dryer, and which utilizes a shroud in conjunction with an air inlet to minimize the effects of air turbulence within the blower apparatus of the dryer.

BACKGROUND OF THE INVENTION

Most of today's homes include carpeting in at least one, if not all, of the rooms of the household. When mishaps occur, such as flooding, roof leakage, or plumbing failure, oftentimes such carpeting becomes saturated with water, thus necessitating the taking of special measures to dry the carpeting. Generally, to accomplish this drying process, large commercial air dryer units are utilized. Typically, these devices contain large motor and fan assemblies and are positioned along the outer edges of the carpet such that the air outlet portion of the device is located underneath the carpet to provide a continuous stream of drying air between the carpet and the surface of the underlying floor. Thus, in order for the drying unit to function properly, it is necessary that the carpeting remain positioned above the outlet portion of the device. Presently known and manufactured commercial drying units contain no such mechanism for securing the carpet to the top surface of the outlet portion. To accomplish this purpose, oftentimes bricks or other miscellaneous heavy objects are used to pin the carpet to the top surface of the outlet portion. As can be easily appreciated, the use of such objects for securing the carpet to the outlet portion is often troublesome and in some cases leads to damage of the floor and/or surrounding walls when the object falls from the device. The present invention alleviates these and other problems by providing a carpet drying apparatus which includes a mechanism integrated with the outlet portion of the device for properly securing wet or damp carpeting to the top surface thereof.

SUMMARY OF THE INVENTION

In accordance with the preferred embodiment of the present invention, there is provided a portable device for drying carpet or the like. The device generally comprises a housing having both a main cylindrical portion and an air outlet portion. The cylindrical portion of the housing is hollow, having two axially aligned open ends for receiving air. Disposed within the cylindrical portion between the open ends is an air blower apparatus, generally consisting of a motor which is integrally connected to a fan assembly. Disposed on the exterior surface of the cylindrical portion is a cord wrapping and storage apparatus. This apparatus is generally comprised of a plurality of projections which extend in opposite direction and define interior slots. The cord which is used to electrically connect the motor to an external power source is wrapped and stored within the slots. Also disposed on the exterior surface of the cylindrical portion is a handle assembly. The handle assembly is comprised of an elongated member which angularly extends from the exterior surface of the cylindrical portion. Projecting from the outer end of the member is the cord for connecting the motor to a power source. The handle assembly itself is offset to one side of the cylindrical portion and positioned such that it is secured to the outer surface of the cylindrical portion directly above the motor. Because the motor is the heaviest component of the entire apparatus, placing the carrying handle in this particular location makes it easier to balance the entire device during the handling and transportation thereof. Included on one open end of the cylindrical portion is a shroud which is positioned over both the motor and motor mount. The shroud, which defines aerodynamic surfaces, is constructed of a plastic material and is used to minimize the effects of air turbulence within the air blower apparatus of the device, thus providing for a smoother and more efficient outlet flow of air from the device.

The outlet portion of the device defines an elongated opening from which the out-flowing air passes. Disposed within the opening is a grating comprised of a plurality of overlapped, horizontally and vertically disposed members. The grating serves to protect the interior of the housing (i.e. the air blower apparatus) by preventing large objects from entering or falling into the air outlet. Disposed on the top surface of the outlet portion is a mechanism for securing carpeting to the top of the outlet portion, thus allowing the device to function properly under the carpeting. Integral parts of this securing mechanism are the vertical members associated with the grating which extend upwardly through the upper wall of the outlet portion and protrude from the top surface thereof. These upper ends of the vertical members are sharpened and extend into the lower surface of the carpeting, thus preventing its slippage from the top surface of the outlet portion. To maintain the carpeting in a position above the vertical members, a retaining bar is provided which is integrally connected to the top surface of the outlet portion. This retaining bar serves to pin the carpeting to the vertical members thus maintaining it on the top surface. The bar is biased by coil spring assemblies which are disposed on each end thereof and attached to the top surface of the outlet portion, and is designed such that it may be lifted with a moderate amount of upward force being supplied by the operator.

An object of the present invention is to provide a portable carpet drying device having a mechanism for securing carpeting to the top surface of the air outlet portion of the device.

Another object of the present invention is to provide a portable carpet drying device having an offset handle disposed on the housing to aid in lifting and transporting the drying device.

A further object of the present invention is to provide a portable carpet drying device having a shroud disposed over one air inlet for minimizing air turbulence within the air blower apparatus of the device and enhancing the outlet flow of air from the device.

A still further object of the present invention is to provide a portable carpet drying device having an apparatus for easily winding and storing an electrical cord.

Further objects and advantages of the invention will become apparent to those skilled in the art upon reading and consideration of the following description of a preferred embodiment and the accompanying drawings.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
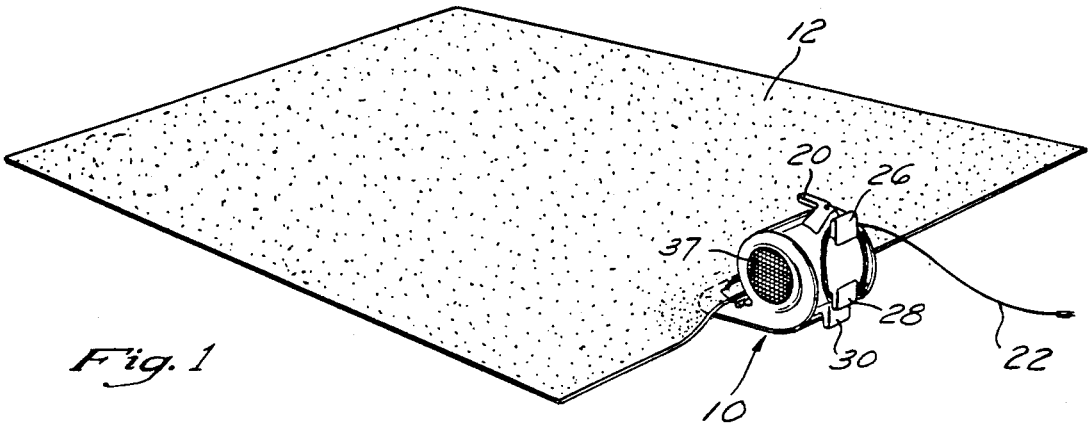
FIG. 1 is a perspective view of the present invention as positioned during a carpet drying process.

Referring now to the drawings wherein the showings are for purposes of illustrating a preferred embodiment of the present invention only, and not for the purposes of limiting the same, FIG. 1 illustrates the positioning of the dryer 10 with respect to a carpet 12 during the drying process. Importantly, dryer 10 is positioned such that it may direct a continuous stream of air between carpet 12 and the underlying floor. It will be appreciated that with large carpets, it is generally desirable that more than one dryer 10 be positioned about the periphery of the carpet 12 to facilitate the drying process.

Figure 2:
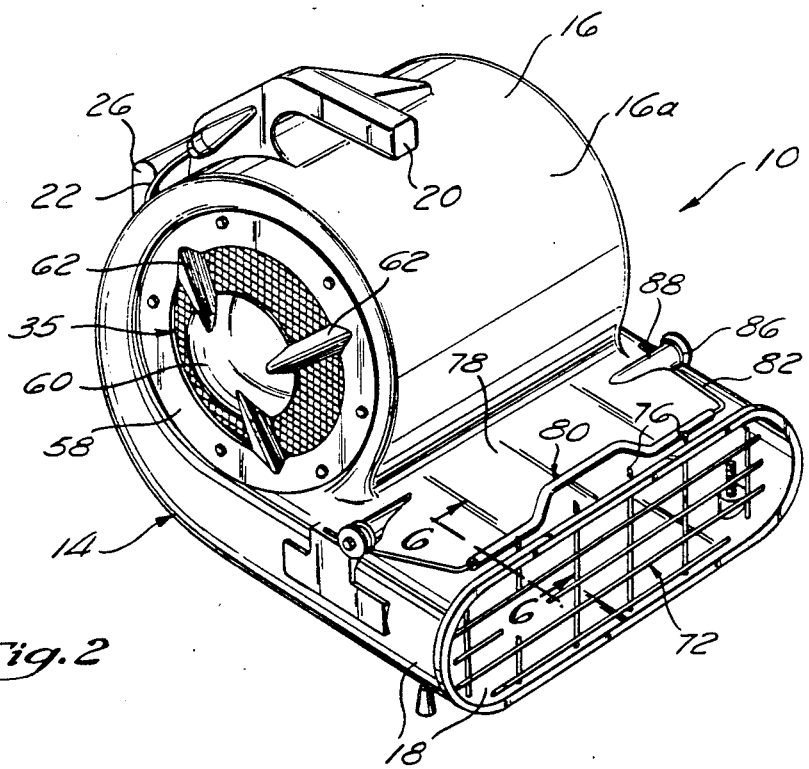
FIG. 2 is a perspective view of the preferred embodiment of the present invention.
Figure 4:
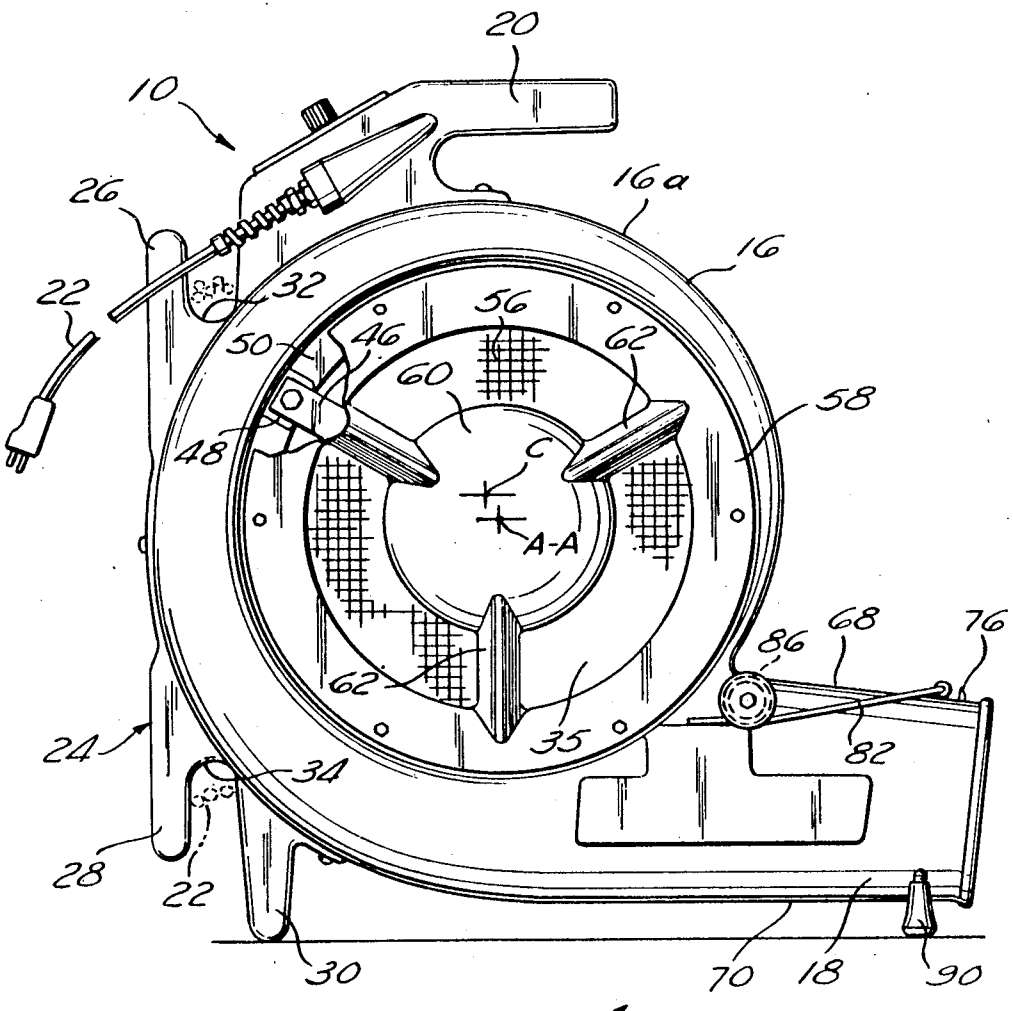
FIG. 4 is a side elevational view of the present invention illustrating the cord wrapping and storage apparatus.

Referring no to the perspective view of the dryer 10 shown in FIG. 2, dryer 10 is generally comprised of a housing 14 which includes a cylindrical portion 16 and an air outlet portion 18. Housing 14 is preferably rotationally molded or otherwise constructed from a suitable plastic or other lightweight material. Molded on the exterior surface 16*a* of cylindrical portion 16 is a handle 20. Importantly, in the preferred embodiment of the present invention, handle 20 is offset to one side of cylindrical portion 16. The purpose of this offset position is to aid in transporting dryer 10 and will be described in greater detail below. Protruding from handle 20 is a cord 22 which is used to electrically connect dryer 10 to a suitable power source (not shown). Also molded on exterior surface 16*a* of cylindrical portion 16 is a winding assembly 24 which is used to wrap and store cord 22 when dryer 10 is not in use. Winding assembly 24 is comprised of an upper extension 26, a first lower extension 28, and a second lower extension 30, as best seen in FIG. 4. Upper extension 26 is disposed such that it extends upwardly from exterior surface 16*a* of cylindrical portion 16. First lower extension 28 and second lower extension 30 are both disposed on exterior surface 16*a* such that they extend downwardly, with first lower extension 28 being positioned such that it vertically opposes upper extension 26. A first notch 32 is formed by upper extension 26 and handle 20 and a second notch 34 is formed by first lower extension 28 and second lower extension 30. When cord 22 is stored, it is wound about winding assembly 24 such that it is successively lapped into first notch 32 and second notch 34.

Figure 5:
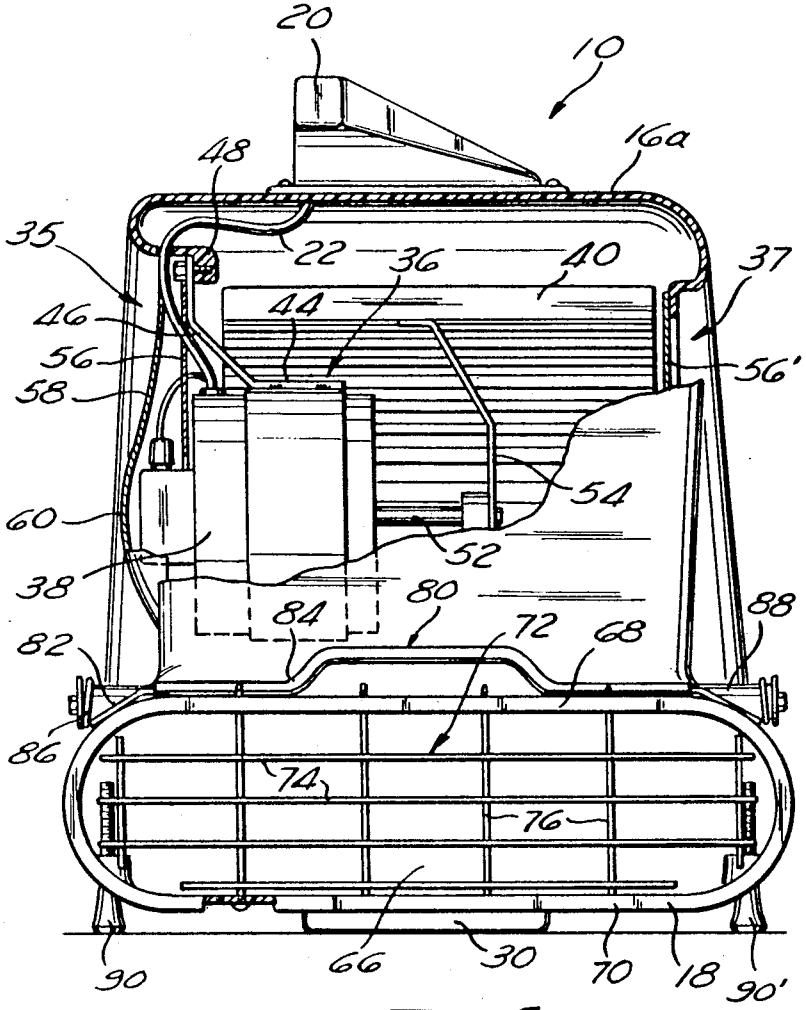
FIG. 5 is a front view of the present invention including a cut-away portion illustrating the blower apparatus.

Cylindrical portion 16 is molded so as to include a hollow interior portion having a first open end 35 and a second open end 37 on each end thereof. First open end 35 and second open end 37 are axially aligned along axis A—A and are adjusted to receive air for the operation of dryer 10. Importantly, axis A—A is disposed such that it is slightly offset from the central axis C of cylindrical portion 16, as best seen in FIG. 4. Disposed within the interior of cylindrical portion 16 along axis A—A is an air blower apparatus 36 which is shown in an exploded view in FIG. 3. Blower apparatus 36 is primarily comprised of a motor 38 and a fan 40. Used to attach motor 38 to cylindrical portion 16 is a motor mount 42. Motor mount 42 includes a circular flange 44 which is frictionally engaged to the outer surface of motor 38. Equidistantly disposed about the outer diameter of flange 44 are three outwardly extending, generally rectangular struts 46. Motor supports 48 are disposed about a circular lip 50 which is molded into first open end 35 of cylindrical portion 16. Struts 46 are attached to motor supports 48 which are spaced on lip 15 to correspond to the positions of struts 46. Extending outwardly from one end of motor 38 is a shaft 52 which is used to impart rotational movement to fan 40. Shaft 52 is cooperatively engaged to fan 40 through the attachment of shaft 52 to a mounting plate 54 which is disposed within the interior of fan 40 as best seen in FIG. 5. In this respect, impartation of rotational movement by shaft 52 to plate 54 causes the corresponding rotational movement of fan 40. Disposed on each end of blower apparatus 36 are screens 56, 56′ which are used to prevent foreign objects from entering blower apparatus 36 and possibly causing damage thereto. Also attached to lip 50 of cylindrical portion 16 is a circular shroud 58. Shroud 58, which defines aerodynamic surfaces, includes a circular, dome-like center portion 60 and three outwardly extending strut covers 62 which are equidistantly spaced about the periphery of center portion 60 to correspond with the positions of struts 46 about flange 44. As previously stated, handle 20 is positioned to one side and outer surface 16*a* of cylindrical portion 16. In the preferred embodiment of the present invention, handle 20 is positioned directly over motor 38. Because motor 38 is the heaviest component of dryer 10, the positioning of handle 20 over motor 38 aids in the handling and moving of the dryer 10 due to the favorable weight distribution and balance achieved by such a configuration.

With respect to the operation of dryer 10, air is taken into blower apparatus 36 axially through first open end 35 and second open end 37 of cylindrical portion 16. Air entering cylindrical portion 16 through second open end 37 passes through screen 56′ and into fan 40. However, air entering through first open end 35, after passing through screen 56, must pass over motor 38 and struts 46 before entering fan 40. The obstruction of the air flow by motor 38 and struts 46 causes turbulence within fan 40, thus adversely affecting the efficiency of the outlet flow of air from blower apparatus 36. In this respect, shroud 58 is placed over first open end 35 such that center portion 60 is axially aligned with motor 38 and strut covers 62 are positioned over each of struts 46. Due to the aerodynamic configuration of shroud 58, when the air flow is directed over center portion 60 and strut covers 62, as opposed to directly colliding with motor 38 and struts 46, the amount of air turbulence within fan 40 is greatly reduced, thereby increasing the output efficiency of dryer 10.

Figures 3, 6:
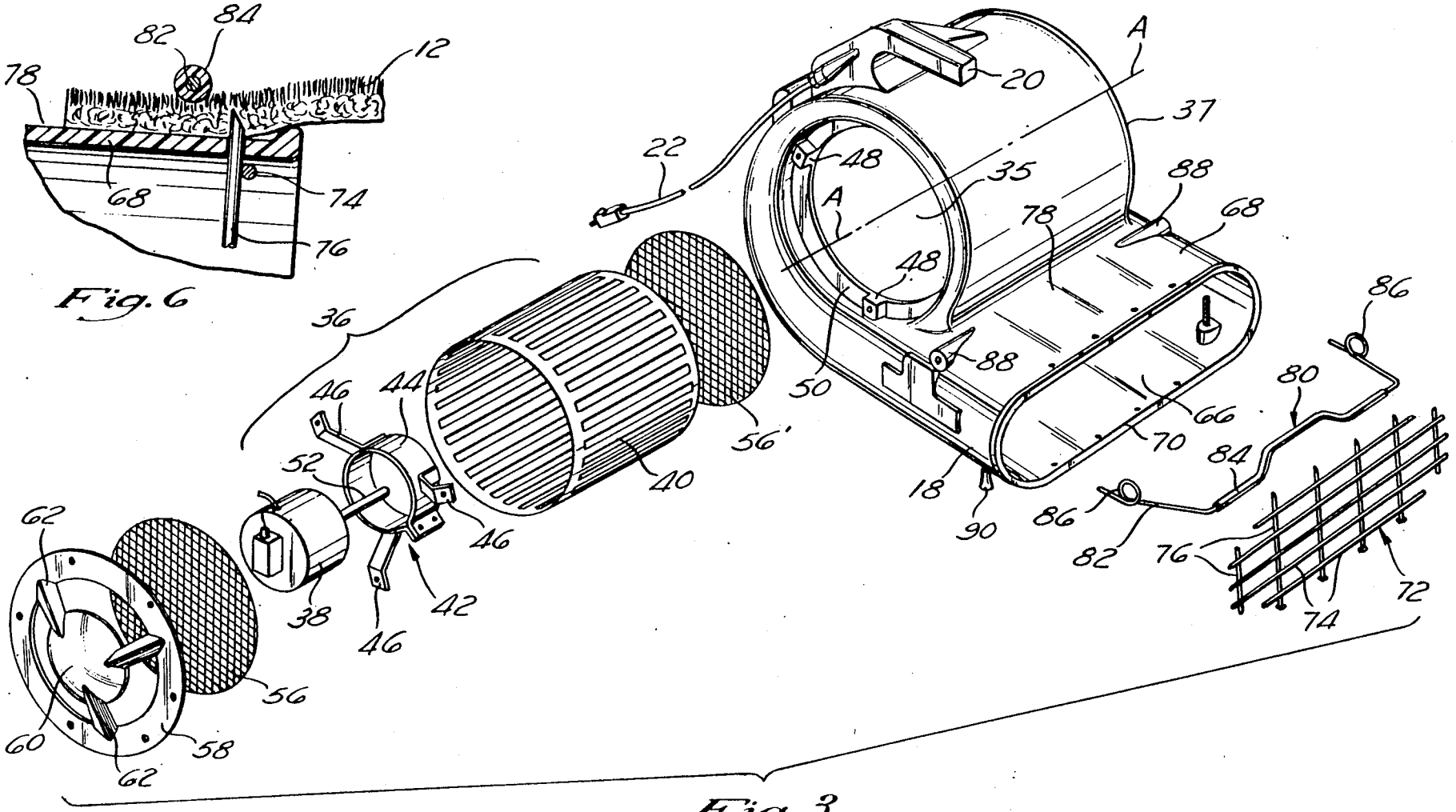
FIG. 3 is an exploded view of the present invention detailing the components of the blower apparatus and securing mechanism.
FIG. 6 is a side sectional view of the securing mechanism taken along line 6—6 of FIG. 2, illustrating the engagement of a carpet to the securing mechanism.

Air is discharged from dryer 10 through the outlet portion 18 of housing 14. Outlet portion 18 defines a generally elongated opening 66 therein having an upper wall 68 and a lower wall 70. Contained within opening 66 is a grate assembly 72, which is comprised of a plurality of interconnected horizontally disposed members 74 and vertically disposed members 76. Grate 72 is used primarily for preventing large objects from entering outlet portion 18 and possibly causing damage to any components of blower apparatus 36. Importantly, the upper ends of vertical members 76 extend through upper wall 68 such that they protrude a small distance from top surface 78 of upper wall 68. These upper ends of vertical members 76 are sharpened as best seen in FIG. 6, for reasons that will be explained in greater detail below. The lower ends of vertical members 76 are contained within lower wall 70 of outlet portion 18 which aids in maintaining grate 72 within opening 66.

In the preferred embodiment of the present invention, carpet 12 is secured to top surface 78 of upper wall 68 through the utilization of a securing mechanism 80 in conjunction with the sharpened ends of vertical members 76. Securing mechanism 80 is comprised of a retaining bar 82 having a middle portion covered by a sleeve 84. Retaining bar 82 includes coil spring assemblies 86 disposed on each end thereof, which are rigidly attached to spring supports 88 molded within upper wall 68 of outlet portion 18. Coil springs 86 operate to bias retaining bar 82, which pivots about spring supports 88, against top surface 78 of upper wall 68. Referring now to FIG. 6, when dryer 10 is utilized to dry a carpet 12, initially retaining bar 82 is raised by the hand of an operator, and the lower surface of an edge of carpet 12 is abutted against top surface 78 of upper wall 68 such that the upper sharpened ends of vertical members 76 penetrate into the lower surface of carpet 12. Retaining bar 82 is then released by the hand of the operator and allowed to come to rest on the top surface of carpet 12. The biasing force of coil springs 86 on retaining bar 82 maintains the carpet 12 on the sharpened edges of vertical member 76, thus maintaining the carpet 12 on top surface 78 during the drying process. After the drying of carpet 12 has been completed, retaining bar 82 is once again raised by the hand of the user and carpet 12 is lifted vertically off of the sharpened ends of vertical support members 76 thereby releasing carpet 12. It will be appreciated that any protuberance or non-skid surface (i.e. bumps, ridges, etc.) may be used to augment the frictional engagement of carpet 12 to top surface 78. Additionally, the vertical orientation of outlet portion 18 may be varied through the rotation of adjustable feet 90, 90' which are threadingly received into lower wall 70 of outlet portion 18. Adjustable feet 90, 90' together with second lower extension 30 of winding assembly 24 also form a support base for dryer 10, as best seen in FIGS. 4 and 5.

Additional modifications and improvements of the invention may also be apparent to those skilled in the art, thus, the particular combination of parts described and illustrated herein is intended to represent only one embodiment of the invention, and is not intended to serve as limitations of alternative devices within the spirit and scope of the invention.

What is claimed is:

1. A portable device for drying carpet comprising:

a housing having an inlet and an outlet;

an air blower carried by said housing for accelerating air from said inlet and through said outlet; and means mounted upon said housing for maintaining an edge of the carpet desired to be dried at an elevation above said outlet to enable air accelerated through said outlet to travel beneath said carpet.

2. A device as defined in claim 1 wherein said housing comprises:

a generally hollow, cylindrical portion having an interior and exterior surface and first and second open ends therein, said first and second open ends defining said inlet, and wherein said outlet defines an elongated opening having an upper and lower surface, said elongated opening including a grating assembly disposed therein.

3. A device as defined in claim 2 wherein said air blower comprises:

a motor rotatably connected to a fan, said motor and said fan disposed within said cylindrical portion of said housing wherein said motor is attached to said housing by at least one strut; and first and second screens disposed within said first and second open ends of said cylindrical portion.

4. A device as defined in claim 2 wherein said means for maintaining said carpet at an elevation above said outlet comprises:

a plurality of elongated vertical members associated with said grating assembly, said vertical members including sharpened points on one end thereof, said sharpened points extending upwardly through said upper wall of said elongated opening of said outlet;

a retaining bar integrally connected to said outlet, said retaining bar operatively engaging said upper wall of said housing; and biasing means for maintaining said retaining bar in a position adjacent said upper wall.

5. A device as defined in claim 4 wherein said biasing means comprises one or more coil springs associated with said retaining bar.

6. A device as defined in claim 1 wherein said housing includes a means for wrapping and storing an electrical cord about said housing.

7. A device as defined in claim 6 wherein said wrapping and storing means comprises at least two oppositely extending members disposed on said exterior surface of said cylindrical portion, said members defining notches for receiving said electrical cord.

8. A device as defined in claim 3 wherein said housing includes a handle assembly, said handle assembly comprising an elongated projection extending outwardly from said exterior surface of said cylindrical portion, said projection being disposed above said motor for properly supporting said dryer.

9. A device as defined in claim 3 wherein said air blower includes a shroud associated therewith, said shroud comprising a dome-like center portion sized to cover said motor and having at least one generally rectangular member extending outwardly from said center portion sized to cover said strut, said shroud being attached to said first open end of said cylindrical portion to prevent air entering said first open end from directly contacting said motor and said strut.

10. A portable device for drying carpet comprising:

a housing;

an air blower disposed within said housing; and means for maintaining an edge of said carpet at an elevation above at least a portion of said housing during a drying process.

11. A device as defined in claim 10 wherein said housing includes an air inlet portion and an air outlet portion, said securing means being disposed on said housing at an elevation above said outlet portion.

12. A device as defined in claim 11 wherein said means for maintaining said carpet at an elevated level comprises:

means for frictionally engaging said carpet to said outlet portion;

a retaining bar associated with said outlet portion, wherein said retaining bar is sized, configured, and positioned to co-act with said engaging means when securing said carpet to said outlet portion; and a biasing means for maintaining said retaining bar in a cooperative relationship with said engaging means.

13. A device as defined in claim 12 wherein said engaging means comprises a plurality of protuberances extending upwardly from said outlet portion.

14. A device as defined in claim 12 wherein said biasing means comprises one or more coil springs associated with said retaining bar.

15. An improved portable dryer for carpet of the type in which a housing includes an air inlet portion and an air outlet portion, and in which a blower apparatus is disposed within said housing to take air through said inlet portion and discharge said air through said outlet portion at a high velocity, wherein said improvement comprises:

means positioned proximal said inlet portion for reducing air turbulence within said blower assembly, said blower assembly comprising a motor rotatably connected to a fan, said motor being attached to said housing by at least one strut, wherein said means for reducing air turbulence comprises a shroud defining aerodynamic surfaces, said shroud including a circular dome-like center portion sized to cover said motor, said center portion having at least one generally rectangular member extending outwardly from the periphery thereof sized to cover said strut, wherein said shroud prevents air entering said inlet from directly contacting said motor and said strut.

16. A device as defined in claim 15 wherein said improvement further comprises:

means disposed upon said housing for maintaining an edge of said carpet at an elevation above said outlet portion.

17. A device as defined in claim 16 wherein said means for maintaining said carpet at an elevated level comprises:

means for frictionally engaging said carpet to said outlet portion; and a retaining bar integrally connected to said outlet portion, said retaining bar including coil springs on either end thereof for maintaining said retaining bar in a cooperative relationship with said engaging means, said retaining bar being sized, configured, and positioned to coact with said engaging means when securing said carpet to said outlet portion.

* * * * *